United States Patent [19]

Covert et al.

[11] 4,337,961

[45] Jul. 6, 1982

[54] SKATEBOARD

[76] Inventors: William J. Covert, 700 Mickle St., Millville, N.J. 08332; Melvyn B. Strickman, R.D. 1, Lawrence Rd., Bridgeton, N.J. 08302

[21] Appl. No.: 94,977

[22] Filed: Nov. 16, 1979

[51] Int. Cl.[3] ..... A63C 17/10

[52] U.S. Cl. ..... 280/87.04 A; 280/11.1 ET

[58] Field of Search ..... 280/11.1 ET, 11.22, 280/11.23, 11.27, 11.28, 12 H, 13, 17, 28.5, 87.04 R, 87.04 A, 11 BT; 180/24.03

[56] References Cited

U.S. PATENT DOCUMENTS

| | | | |
|---|---|---|---|
| 1,317,653 | 9/1919 | Norelius | 280/28.5 |
| 1,822,324 | 9/1931 | Streich | 280/28.5 X |
| 1,953,051 | 3/1934 | Linn | 280/28.5 |
| 2,260,027 | 10/1941 | Hotson | 280/11.1 ET |
| 2,625,229 | 1/1953 | Voorhees | 280/11.1 ET |
| 3,203,706 | 8/1965 | Boyden | 280/87.04 R X |
| 3,326,569 | 6/1967 | Leeming | 280/17 X |
| 4,062,557 | 12/1977 | Roden | 280/87.04 A |
| 4,092,031 | 5/1978 | Greer et al. | 280/28.5 |
| 4,114,913 | 9/1978 | Newell et al. | 280/87.04 A X |

OTHER PUBLICATIONS

*Mad Magazine,* Mar. 1977, No. 189, p. 12.

*Primary Examiner*—Richard A. Bertsch
*Assistant Examiner*—Michael Mar
*Attorney, Agent, or Firm*—Duffield & Lehrer

[57] ABSTRACT

A skateboard includes conventional carriages and axles supported on the underside thereof. Each axle has a truck pivotally supported on either end and each truck includes front and rear wheels. Each of the four trucks is pivotal independently of each of the others and is spring biased in an intermediate position. An endless belt passes around and is supported by the wheels on each of the four trucks.

3 Claims, 5 Drawing Figures

SKATEBOARD

BACKGROUND OF THE INVENTION

This invention relates to a skateboard and more particularly toward a skateboard including a plurality of endless tracks for independently movable trucks which improve the operation and stability of the skateboard.

As is well known in the art, conventional skateboards include a footboard with front and rear carriages mounted on the under surface thereof. The front and rear carriages support front and rear axles, respectively. Two front wheels are mounted on the opposite ends of the front axle and two rear wheels are mounted on the opposite ends of the rear axle.

Such conventional skateboards have proven to be very commercially successful. Unfortunately, they have also proven to be extremely dangerous. Because of the wheel arrangement, when the skateboard passes over a small bump or stone or the like, its operation becomes extremely unstable causing the rider to be thrown therefrom. This becomes even more particularly dangerous when the skateboard is being utilized on a street or sidewalk since the rider stands the chance of being hit by a motor vehicle if thrown from the skateboard.

Applicants are aware of at least one proposed attempt to reduce the above problem. This proposed solution is an eight wheel skateboard which is described in U.S. Pat. No. 4,062,557. The patented device substitutes front and rear trucks on the front and rear axles instead of the standard wheel pairs. Each truck is in the form of a rectangular frame having four wheels mounted adjacent its four corners. Applicants believe, however, that this prior art device is still not satisfactory since movement of a wheel on one side of the skateboard results in similar movement of the complementary wheel on the other side of the skateboard. Thus, it does not appear that this prior art skateboard is substantially safer than the conventional skateboard.

SUMMARY OF THE INVENTION

The present invention overcomes the problems of the prior art devices and provides a skateboard which is so stable that it can be used on relatively rough terrain. Because of this, the skateboard of the present invention may be used on surfaces other than a street or sidewalk and is therefore inherently much safer than conventional skateboards. The skateboard of the present invention includes conventional carriages and axles supported on the underside thereof. Each axle has a truck pivotally supported on either end and each truck includes fron and rear wheels. Each of the four trucks is pivotal independently of each of the others and is spring biased in an intermediate position. An endless belt passes around and is supported by the wheels on each of the four trucks.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
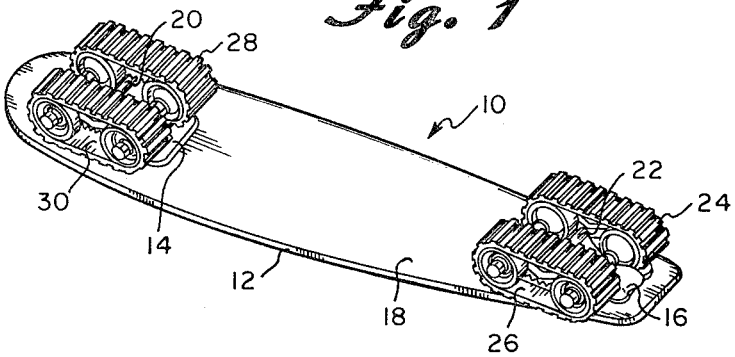
FIG. 1 is a rear perspective view of the bottom of a skateboard constructed in accordance with the principles of the present invention.

Referring now to the drawings in detail wherein like reference numerals have been used throughout the various figures to designate like elements, there is shown in FIG. 1 a skateboard constructed in accordance with the principles of the present invention and designated generally as 10. Skateboard 10 includes a footboard 12 of conventional shape which includes front and rear carriages 14 and 16, respectively, mounted on the lower surface 18 of the footboard. The carriages 14 and 16 are of a substantially conventional construction and accordingly the details thereof are not believed necessary. The front carriage 14 supports a front axle 20 in the conventional manner and similarly the rear carriage 16 suports a rear axle 22 also in a conventional manner. Similarly in a conventional manner, steering of the skateboard is accomplished by tilting of the footboard.

Conventional skateboards include a single wheel mounted on each end of the front and rear axles 20 and 22. The present invention substitutes a truck for each of the conventional wheels. There are, therefore, four separate trucks 24, 26, 28 and 30. Each of the trucks is constructed identically as each of the other trucks. (The trucks on the left side, of course, being mirror images of the right trucks.) Accordingly, a detailed description of only one truck 24 will follow. It being understood that the remaining trucks are constructed in substantially the same manner.

Figure 2:
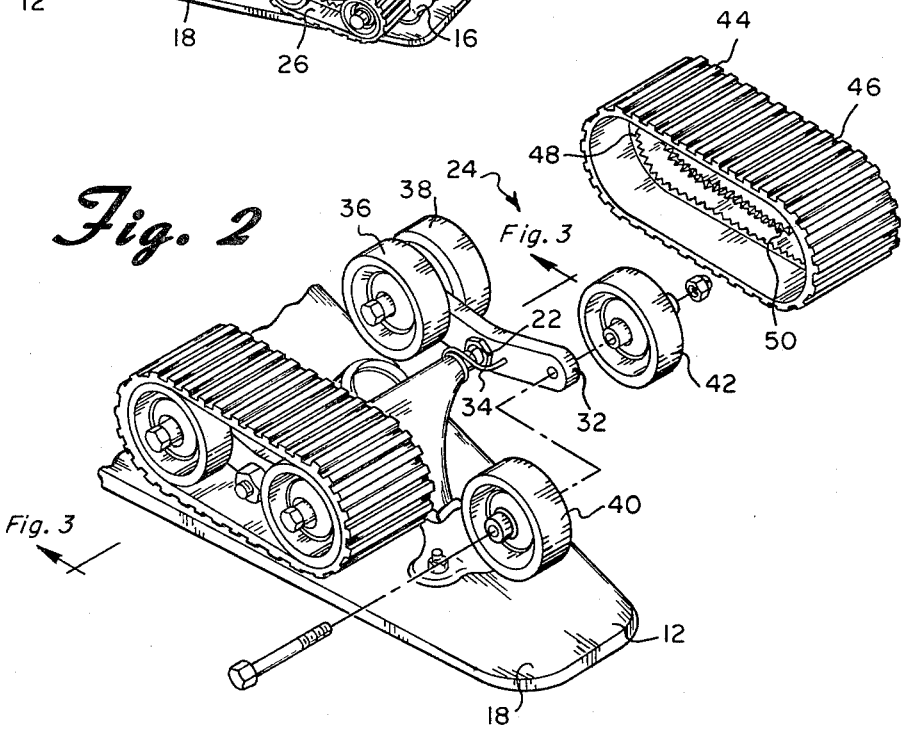
FIG. 2 is an enlarged exploded view of the rear wheel means shown in FIG. 1.

As shown most clearly in FIG. 2, truck 24 includes a longitudinally extending support member 32 which is mounted adjacent its midpont to the end of axle 22. The support member 32 is mounted on the axle 22 in such a manner that either end of the support member 32 may pivot or rock toward and away from the footboard 12. A wire spring 34 has one end attached to the support member 32 and the other end secured to the carriage 16. Spring 34 biases the support member 32 into an intermediate position wherein it is substantially parallel to the surface 18.

Rotatably mounted adjacent the forward end of support member 32 are a pair of wheels 36 and 38. Similarly, a pair of wheels 40 and 42 are rotatably mounted adjacent are rearward end of the support member 32.

An endless track or belt 44 or the like having a width approximately equal to the combined width of the wheels 36 and 38 and the support member 32 fits around and is supported by the four wheels of the truck 24. The belt 44 may be comprised of a natural or synthetic rubber material and preferably includes a plurality of treads 46 on the outer surface thereof.

Figure 3:
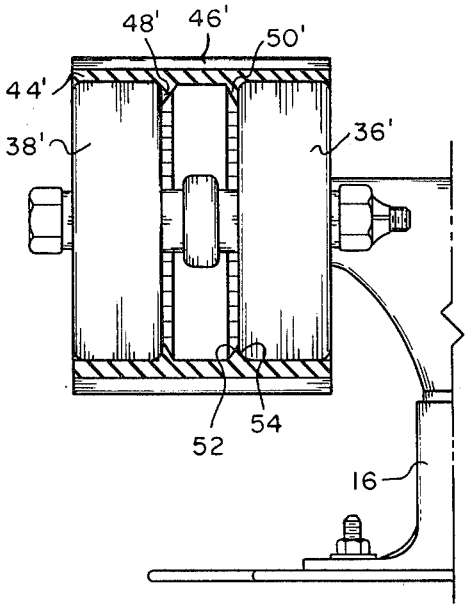
FIG. 3 is a cross-sectional view taken through the line 3—3 of FIG. 2.

Extending inwardly from the inner surface of the belt 44 adjacent the center thereof are two rows of projections 48 and 50. As shown most clearly in FIG. 3, the purpose of the projections 48 and 50 is to properly align and maintain the belt on the wheels. It should be noted that each of the elements shown in FIG. 3 is marked with a prime since FIG. 3 illustrates truck 26 rather than truck 24. Accordingly, each prime element will be understood to be substantially identical to the unprimed elements shown in FIG. 2. Preferably, the projections 48' and 50' have a tapered inner surface such as shown, for example, at 52 and a substantially perpendicular outer surface such as shown at 54. The outer surface 54 is contact with the wheels aids in maintaining the belt in proper alignment with respect thereto.

Figure 4:
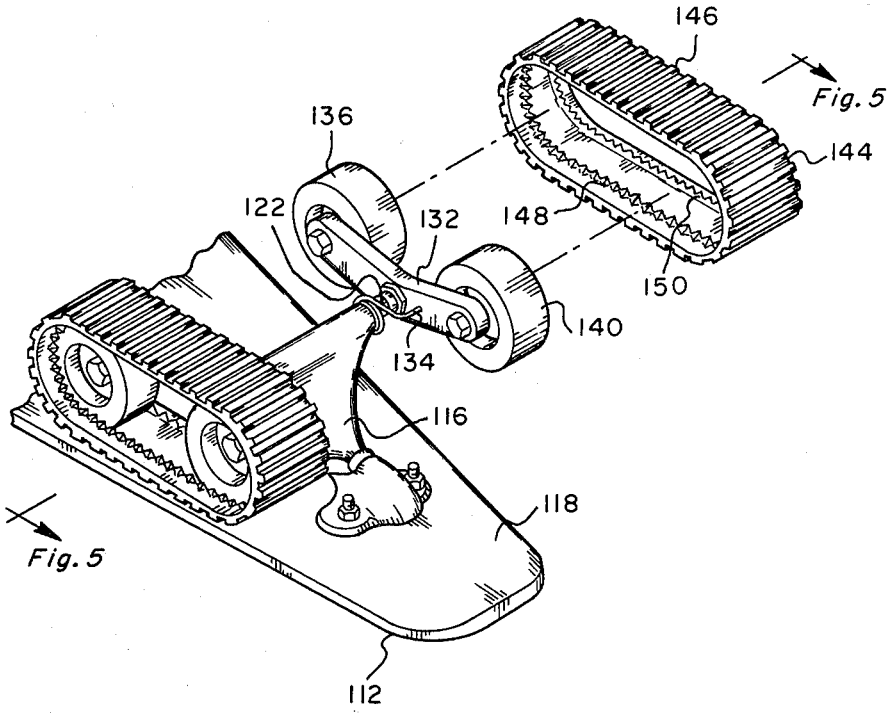
FIG. 4 is a view similar to FIG. 2 showing a second embodiment of the invention.
Figure 5:
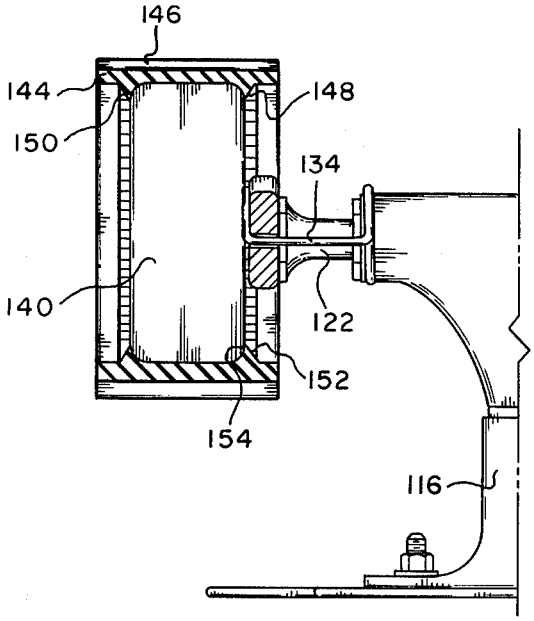
FIG. 5 is a cross-sectional view taken through the line 5—5 of FIG. 4.

A second embodiment of the invention is shown in FIGS. 4 and 5. In this embodiment, the skateboard 112 also has a conventional carriage 116 mounted on the under surface 118 thereof. Carriage 116 also supports a conventional axle 122. As with the first embodiment, a longitudinally extending support member 132 is pivotally connected to the axle 122 and is spring biased into an intermediate position by spring 134. This arrangement is substantially identical to the arrangement described above with respect to the first embodiment.

Rotatably mounted to the forward and rear ends of the support member 132 are wheels 136 and 140. Unlike the first embodiment, only one wheel is mounted at the forward and rear ends of the support member 132. However, these wheels are preferably somewhat wider than the wheels shown in FIGS. 1–3.

An endless belt 144 similar to belt 44 and also having a plurality of treads 146 on the outer surface thereof passes around and is supported by the wheels 136 and 140. Belt 144 includes a plurality of projections 148 and 150 on the inner surface thereof which are also somewhat similar to the projections 48 and 50. However, as shown most clearly in FIG. 5, the projections 148 and 150 have tapered outer surfaces 152 and substantially perpendicular inner surfaces 154. Thus, the shape of the projections 148 and 150 are substantially the reverse of the projections 48 and 50. As shown in FIG. 5, the substantially perpendicular inner surfaces 154 maintain the belt 144 in proper alignment on the wheels.

The operations of the skateboard shown in FIGS. 1–3 and in FIGS. 4 and 5 are substantially identical. In each case, the endless belt allows the skateboard to be operated on relatively rough terrain such as grass or dirt or the like where conventional wheel skateboards normally cannot operate. The rocking action of each truck absorbs small bumps and the like. In addition, since each of the trucks pivots independently of the remaining trucks, a bump on the left side of the skateboard will be absorbed without transferring the motion to the right side. As a result of this arrangement, the present skateboard can be ridden on relatively rough terrain and still give a smooth ride and accordingly the significant danger of falling from the skateboard and having a collision with a motor vehicle is eliminated. Furthermore, if one should fall from the skateboard of the present invention, they would fall into the grass or dirt or other relatively soft surface as opposed to the hard surface of a sidewalk or street.

The present invention may be embodied in other specific forms without departing from the spirit or essential attributes thereof and, accordingly, reference should be made to the appended claims rather than to the foregoing specification as indicating the scope of the invention.

We claim:

1. In a skateboard including a footboard, front and rear under carriages mounted on the lower surface of said footboard, and front and rear axles carried by said front and rear carriages respectively wherein steering is accomplished by tilting of the footboard, the improvement comprising: right and left truck means pivotally mounted on each of said axles, each truck means being pivotally movable independently of each other truck means; each of said truck means including a longitudinally extending support member pivotally mounted on its respective axle adjacent the middle of said support member and including first wheel means mounted adjacent the forward end of said support member and second wheel means mounted adjacent the rearward end of said support member an endless belt passing around and being supported by said first and second wheel means of each of said truck means and spring means for biasing each of said truck means into an intermediate position.

2. In a skateboard as claimed in claim 1 wherein each endless belt includes means on the inner surface thereof for maintaining the same in proper alignment on said wheel means.

3. In a skateboard as claimed in claim 1 wherein each of said wheel means includes a pair of wheels mounted on either side of said support member.

* * * * *